US006580351B2

(12) United States Patent
Davis et al.

(10) Patent No.: US 6,580,351 B2
(45) Date of Patent: Jun. 17, 2003

(54) LASER ADJUSTED SET-POINT OF BIMETALLIC THERMAL DISC

(76) Inventors: George D. Davis, 806 150th Pl. SE., Bellevue, WA (US) 98007; Robert F. Jordan, 22816 34th Ave. W., Brier, WA (US) 98036

( * ) Notice: Subject to any disclaimer, the term of this patent is extended or adjusted under 35 U.S.C. 154(b) by 0 days.

(21) Appl. No.: 09/976,388

(22) Filed: Oct. 11, 2001

(65) Prior Publication Data

US 2002/0044624 A1 Apr. 18, 2002

Related U.S. Application Data

(60) Provisional application No. 60/240,482, filed on Oct. 13, 2000.

(51) Int. Cl.[7] ..... H01H 71/16; H01H 71/08

(52) U.S. Cl. ..... 337/111; 337/379; 337/36; 337/57; 337/333

(58) Field of Search ..... 337/16, 36, 53, 337/57, 111, 333, 343, 379, 347; 29/622

(56) References Cited

U.S. PATENT DOCUMENTS

| | | | | | |
|---|---|---|---|---|---|
| 1,895,590 | A | * | 1/1933 | Spencer | 337/379 |
| 2,717,936 | A | * | 9/1955 | Bolesky | 337/343 |
| 2,954,447 | A | * | 9/1960 | Bolesky et al. | 337/343 |
| 3,579,167 | A | * | 5/1971 | Grable | 337/102 |
| 3,656,080 | A | * | 4/1972 | Wells | 337/111 |
| 3,748,888 | A | * | 7/1973 | Gerich | 72/375 |
| 4,090,166 | A | * | 5/1978 | Burch | 337/360 |
| 4,400,679 | A | * | 8/1983 | Snider | 337/382 |
| 4,507,642 | A | * | 3/1985 | Blackburn | 337/89 |
| 4,510,481 | A | * | 4/1985 | Ubukata et al. | 337/368 |
| 4,682,141 | A | * | 7/1987 | Hickling | 337/379 |
| 4,823,105 | A | * | 4/1989 | Givler | 337/368 |
| 5,317,471 | A | * | 5/1994 | Izoard et al. | 361/105 |
| 5,337,036 | A | * | 8/1994 | Kuczynski | 337/343 |
| 5,781,097 | A | * | 7/1998 | Givler | 337/367 |
| 5,939,970 | A | * | 8/1999 | Tsuji et al. | 337/343 |
| 6,030,114 | A | * | 2/2000 | DiMarco et al. | 374/1 |
| 6,135,633 | A | * | 10/2000 | DiMarco et al. | 374/1 |
| 2002/0186118 | A1 | * | 12/2002 | Kuczynski | 337/16 |

FOREIGN PATENT DOCUMENTS

| | | | | |
|---|---|---|---|---|
| EP | 913848 | A2 * | 5/1999 | H01H/71/74 |
| JP | 03114687 | A * | 5/1991 | B23K/26/00 |

* cited by examiner

*Primary Examiner*—Anatoly Vortman
(74) *Attorney, Agent, or Firm*—Charles J. Rupnick Attorney at Law

(57) ABSTRACT

A method for post-fabrication modification of the snap actuation properties of a thermally responsive bimetallic actuator by exposing a pre-formed bimetallic actuator to laser energy, thereby permanently altering the thermal response properties of the bimetallic actuator, and a thermally responsive bimetallic actuator having snap actuation properties developed according to the method.

24 Claims, 4 Drawing Sheets

LASER ADJUSTED SET-POINT OF BIMETALLIC THERMAL DISC

This application claims the benefit of U.S. Provisional Application Serial No. 60/240,482, filed in the names of Robert F. Jordan and George D. Davis on Oct. 13, 2000, the complete disclosure of which is incorporated herein by reference.

FIELD OF THE INVENTION

The present invention relates generally to methods for manufacturing thermally responsive bimetallic members, and in particular to methods for permanently compensating thermal response characteristics of snap-action bimetallic members.

BACKGROUND OF THE INVENTION

Thermally responsive bimetallic members that exhibit a snap-action response are commonly utilized to actuate overheat protection and thermostatic switching mechanisms. One type of such switching mechanisms is a thermostatic switch that utilizes an actuator formed of a bimetallic material having materials of relatively low and high thermal expansion coefficients joined together along a common interface. The bimetallic actuators that drive such switching mechanisms typically exhibit a forceful snapping action between two states of stability with each of these states being responsive to a predetermined threshold or set-point temperature. When the switching mechanism senses a temperature that is below a first lower of these predetermined set-point temperatures, the thermally responsive member, i.e. the bimetallic actuator, is in one of the two stable states. Accordingly, when the sensed temperature is above a second higher predetermined set-point temperature, the thermally responsive member forcefully snaps to a second of the two stable states and remains in this second state while the sensed temperature remains above the first lower set-point temperature. Should the sensed temperature be reduced to the first lower temperature, the temperature of the member is lowered correspondingly. As a result, the thermally responsive member forcefully snaps back to the first lower temperature state. The difference between the two predetermined set-point temperatures corresponding to the respective first and second states of stability is known as the "differential temperature" of the thermally responsive member.

A known method of manufacturing thermally responsive snap-action switches of the variety described above has included a forming operation in which a pre-sized blank of thermally responsive bimetallic material is positioned between two opposingly positioned shaping or die members. The shaping members are actuated to engage the blank, thereby forming a bimetallic disc having a configuration that achieves forceful snap-action at each of the two predetermined set-point temperatures. Such a configuration usually consists of a knee and/or corresponding bowed portion, a dimpled portion or portions, or a series of ridges. Examples of such of formations are described in U.S. Pat. Nos. 3,748,888 and 3,933,022, each of which is incorporated herein by reference in its entirety, wherein a thermally responsive snap-action bimetallic disc is provided.

U.S. Pat. No. 3,748,888 also describes a smoothly formed prior art disk-shaped snap-action bimetallic member, as illustrated in side view in FIG. 1. A bimetallic member 1 is formed using a disc of material formed of two materials 2, 3 having different thermal expansion coefficients and joined together along contiguous surfaces. One of the members 2 is formed of a material having a relatively high coefficient or rate of thermal expansion, while the other member 3 is formed of a material having a low rate of thermal expansion relative to that of the first member 2. The difference in thermal expansion coefficients between the two conjoined members 2, 3 is a factor in determining the set-point temperature at which the resulting bimetallic disc actuator 1 operates and in the force F produced by the snap-action. The disk-shaped bimetallic member 1 is often circular and, in some instances, is provided with a small, centrally located aperture therethrough (not shown). Bimetallic discs of this type are generally formed by "bumping" a flat circular disc blank with a punch-and-die set to stretch the bimetallic material of the disc into a concave structure having a depth H1, as illustrated by full line 4 in FIG. 1. The bimetallic disc 1 is formed, for example, with a substantially planar peripheral hoop portion 5 surrounding a central portion 6 that is stretched into a concave configuration. The set-point operation temperature of the snap-action and the force F applied thereby are thus physical characteristics of the two members 2, 3 that form the bimetallic member 1.

Generally, when the bimetallic disc 1 is intended to operate at a temperature above ambient temperature, the disc 1 is bumped on the high expansion side 2 to form the central stretched portion 6, whereby the central portion 6 is stretched to space the inner concave surface thereof to the depth H1 away from the plane P of the peripheral hoop portion 5, as illustrated by the full line configuration 4. The depth of penetration of the punch during the bumping operation determines the depth H1 and thus is another factor in determining both the upper set-point temperature and the force F applied by the snap-action operation of the disc 1. The set-point operation temperature and the force F applied by the snap-action are thus also structural characteristics of the bimetallic member 1, as is also described in above-incorporated U.S. Pat. No. 3,748,888.

In FIG. 1, the full line 4 illustrates the bimetallic disc 1 in one of its two states of stability. Assuming the bimetallic disc 1 is intended for operation at a set-point temperature above ambient temperature, the high expansion rate side is located on the surface 2 and the low expansion rate side is along the surface 3. If the bimetallic disc 1 is intended for operation at a set-point temperature below ambient temperature, the bimetallic disc 1 is formed in the opposite shape with the low expansion rate side located on the surface 2 and the high expansion rate side along the surface 3. For purposes of explanation only, the bimetallic disc 1 shown in FIG. 1 is assumed to be intended for operation at a set-point temperature above ambient temperature. Accordingly, at a temperature well below the upper set-point temperature the bimetallic disc 1 is configured with the central stretched portion 6 in an upwardly concave state, as shown by the upper dotted line 7.

As the temperature of the bimetallic disc 1 is raised to approach its upper set-point operating temperature, the high expansion rate material 2 begins to stretch, while the lower expansion rate material 3 remains relatively stable. As the high expansion rate material 2 expands or grows, it is restrained by the relatively more slowly changing lower expansion rate material 3. Both the higher and lower expansion rate sides 2, 3 become distorted by the thermally induced stresses, and the bimetallic disc 1 changes configuration with a slow movement or "creep" action from the upper dotted line configuration 7 to the full line configuration 4 with the inner concave surface of the central concave portion 6 spaced the depth H1 away from the plane P of the peripheral hoop portion 5. The full line configuration 4 is considered herein to be a first state of stability.

As soon as the temperature of the bimetallic disc 1 reaches its upper predetermined set-point temperature of operation, the central stretched portion 6 of the disc 1 moves with a forceful snap-action downward through the unstretched hoop portion 5 to the second state of stability with the inner concave surface of the central concave portion 6 spaced a distance H2 away from the plane P of the peripheral hoop portion 5, as shown by the phantom line 8. If the temperature of the bimetallic disc 1 is raised to a still higher temperature, the high expansion rate material 2 continues to expand at a greater rate than the relatively lower expansion rate material 3 joined thereto. As a result of this continued differential expansion, the bimetallic disc 1 creeps toward a state of even greater downward concavity, as shown by the second lower dotted line configuration 9.

As the temperature of the bimetallic disc member 1 is reduced form the high temperature toward the lower predetermined set-point temperature of operation, the bimetallic disc 1 moves from the state of extreme concavity, as shown by the lower dotted line 9, toward the second state of stability indicated in phantom 8. As the temperature of the bimetallic disc 1 is reduced below the second or lower predetermined set-point temperature of operation, the material 2 having the relatively larger thermal coefficient also contracts or shrinks more rapidly than the other material 3 having the relatively smaller thermal coefficient. The bimetallic disc 1 changes configuration with a similar slow movement or creep action from the state of greatest downward concavity toward the second state of stability indicated in phantom 8. As the bimetallic disc 1 reaches the lower set-point temperature, the central stretched portion 6 forcefully snaps back through the unstretched hoop portion to the first state of stability, as shown by the upper full line 4. If the temperature is decreased still further, the differential expansion between the high and low rate materials 2, 3 causes the bimetallic disc 1 to continue to creep toward the state of greatest upward concavity, as shown by the upper dotted line 7.

The manufacture of snap-action bimetallic discs 1 results in set-point temperatures that vary with only slight differences in the fabricated thicknesses of each of the materials 2, 3. Material fabrication parameters, such as inconsistencies in the alloy content, and rolling temperatures and pressures also affect set-point temperatures, as do internal material stresses induced both during original forming and during joining together of the individual materials 2, 3. Inconsistencies in the depth of penetration of the punch during the bumping operation that determines the depth H1 introduce more variation in the set-point temperatures, as do time and temperature variations during heat treatment and thermal cycling operations. Other factors also cause variations in the set-point operation temperatures of the finished discs 1.

Thus, tolerance in the set-point operation temperature in many switching mechanisms often exceeds the ability of the fabrication process to reliably reproduce a disc 1 that satisfies the tolerance required by specific applications. The process variations often result in yields below acceptable limits and cause the disc manufacturer to individually screen the manufactured discs at a cost of significant time and effort. Uncertainty in the final yield also upsets the production planning process.

Furthermore, many thermal switch designs use one of the bimetallic discs 1 that snap into a different state of concavity at a predetermined threshold or set-point temperature, thereby closing a contact or other indicator to signal that the set-point has been reached. A minimum force F is required to actuate the switch or indicator. As described above, the force F is thermally induced in the bimetallic disc 1 as the result of both the depth H1 of the concavity formed in the disc 1, and the differential thermal expansion between the high and low expansion sides 2, 3 thereof. The force F produced during transition from one state of stability to the other state must be sufficient to overcome the restoring force in the switch or indicator device in order to actuate the device. If a bimetallic disc 1 with insufficient snap force F is installed into a thermal switch or other indicator device, the switch or device may fail prematurely, requiring replacement of the bimetal disc.

Currently, the force F produced during the snap is tested in situ by placing the disc 1 in the intended device and testing the fully assembled thermal switch or other indicator mechanism. This measurement technique is preceded by pre-screening of the individual bimetallic elements 1 capable of generating a sufficiently powerful snap force F to overcome the restoring forces of the device. For example, the bimetallic discs 1 are pre-tested to ensure that each exerts sufficient snap force F at temperature application rates of about 1 degree per minute or less to overcome a restoring spring force in a flexible switch contact. The testing process is thus cumbersome and time consuming. Furthermore, the present testing process is a simple go/no-go test in which marginally-performing bimetallic discs 1 may remain undiscovered. The manufacturer may thus be forced to employ excessively conservative quality control measures.

Therefore, the manufacture of snap-action bimetallic discs is currently less than optimal, and improved methods of manufacture having more consistent product, and thus higher yields, are desirable.

SUMMARY OF THE INVENTION

The present invention is a means of delicately adjusting the physical properties of a thermally responsive bimetallic actuator by exposing a pre-formed bimetallic actuator to laser energy, thereby permanently altering the thermal response properties of the bimetallic actuator. The present invention thus provides post-fabrication modification of the snap actuation temperature set-points, thereby increasing predictability of temperature set-point and producibility of the bimetallic actuator.

The present invention includes the bimetallic actuator having delicately adjusted physical properties that result in permanently altered thermal response properties.

According to one aspect of the invention, a thermally responsive bimetallic member is provided that exhibits a snap-action response, the bimetallic member including a bimetallic material fabricated of two materials having different coefficients of thermal expansion and formed in a predetermined non-planar shape to achieve a snap-action between first and second stable states as a function of temperature; and an artifact formed in a first of the two materials and cooperating with the non-planar shape to achieve the snap-action.

According to another aspect of the invention, the artifact is a pattern of localized surface heat-treated areas or grooves that cooperates with the non-planar shape to achieve the snap-action of the bimetallic member within a predetermined range of temperatures.

According to another aspect of the invention, the snap-action of the bimetallic member is achieved within a predetermined range of temperatures that is a function at least one of: a value of the coefficient of thermal expansion of the first of the two materials relative to the coefficient of thermal expansion of a second of the two materials, and a physical parameter of the artifact. For example, the physical parameter of the artifact includes one or more of a shape and a position of the artifact.

According to various other aspects of the invention, the snap-action of the bimetallic member achieved by the cooperating non-planar shape and artifact exerts a predetermined force, i.e., the bimetallic member exerts a predetermined amount of energy during the snap-action transition between the first and second stable states. For example, the force exerted by the snap-action is a function of at least a shape and a position of the artifact.

According to yet another aspect of the invention, the predetermined non-planar shape of the bimetallic material is a dish-shape formed centrally of a substantially planar peripheral edge portion.

According to still other aspects of the invention, the bimetallic member is coupled with a pair of relatively movable contacts that are positioned relative to the thermally responsive bimetallic member such that the thermally responsive bimetallic member is positioned to actuate one of the pair of relatively movable contacts. For example, the thermally responsive bimetallic member is positioned to actuate the relatively movable contact by transitioning between one and another of the first and second stable states.

According to yet other aspects of the invention, a method for forming a thermally responsive bimetallic actuator is provided, the method including forming a blank of bimetallic material into a predetermined non-planar shape having a substantially round and planar peripheral edge portion to achieve a snap-action transition between first and second stable states at an initial set-point temperature; and laser treating one surface of the bimetallic material to form a predetermined pattern therein. The method may also include determining the initial set-point temperature prior to the laser treating, and the laser treating results in the snap-action transition being achieved at a set-point temperature that is different from the initial set-point temperature.

According to another aspect of the method of the invention, the laser treating the surface includes treating the surface in a prescribed manner as a function of a predetermined influence of one or more predetermined parameters on the set-point temperature. The prescribed manner of treating the surface may include reference to a representation of influences of predetermined parameters on the set-point temperature. Furthermore, the representation of influences of the parameters may be a graphical representation. For example, the representation may be a nomogram.

According to another aspect of the method of the invention, the method may include determining prior to the laser treating an initial energy exerted by the bimetallic actuator during the snap-action transition, and the laser treating preferably results in the energy exerted by the bimetallic actuator during the snap-action transition being substantially optimized. For example, the energy exerted by the bimetallic actuator during the snap-action transition from the first stable state to the second stable state is made substantially the same as the energy exerted during the snap-action transition from the second stable state to the first stable state.

According to still other aspects of the method of the invention, the pattern formed in the bimetallic material by the laser treating influences the set-point temperature at which the snap-action transition is achieved. The snap-action transition is thus a function of temperature, and the pattern formed by the laser treating.

According to various other aspects of the method of the invention, the thermally responsive bimetallic actuator is formed as a disk and the pattern formed by the laser treating is an annular area of localized surface heat treatment applied, for example, by a low power laser, and being positioned adjacent to the peripheral edge of the disk. Extensive laser treating may remove material thereby inscribing or cutting an annular groove adjacent to the peripheral edge of the disk. Alternatively, the pattern is an annular surface laser-treated area, including a groove, being spaced inwardly of the peripheral edge of the disk. The pattern may also be an annular surface laser-treated area, including an annular groove, being positioned near to the center of the disk of bimetallic material.

According to still another aspect of the method of the invention, the pattern formed by the laser treating influences the energy generated by the bimetallic actuator during the snap-action transition. According to various aspects of the invention, the pattern formed by the laser treating is a plurality of surface heat-treated areas or grooves formed radially to the center of the disk of bimetallic material. Alternatively, the pattern is a plurality of surface heat-treated areas or grooves positioned at an angle to a grain in the surface of the bimetallic material. For example, the heat-treated pattern is positioned substantially crosswise to the grain in the surface of the bimetallic material.

BRIEF DESCRIPTION OF THE FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF PREFERRED EMBODIMENTS

In the Figures, like numerals indicate like elements.

The present invention is a compensation method that provides for delicately adjusting one or both of the set-point temperature and the snap force F by using a laser to physically alter the bimetallic snap-action actuator element. The present invention includes the bimetallic snap-action actuator element resulting from the compensation method as well as the thermostatic switching mechanisms and other indicators that utilize the bimetallic snap-action actuator element of the invention to signal that the set-point has been obtained.

Figure 2:
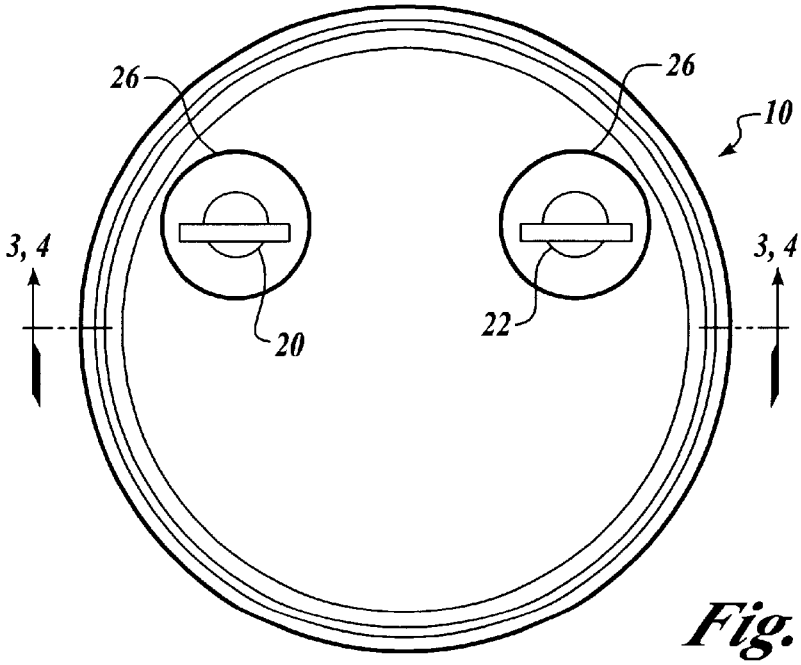
FIG. 2 is a top plan view of the thermally responsive device of the present invention embodied as a snap-action thermal switch including a thermally responsive snap-action actuator of the present invention embodied as a disc-shaped actuator.
Figure 3:
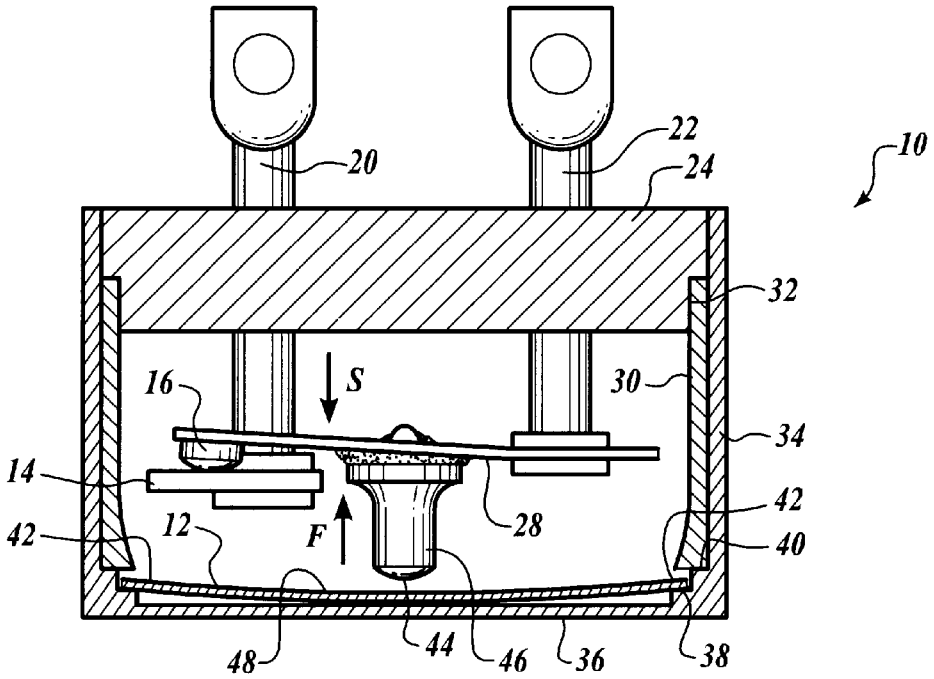
FIG. 3 is a cross-sectional view of the thermally responsive device illustrated in FIG. 2, wherein the thermally responsive snap-action actuator is shown spaced away from an intermediary striker pin, whereby the actuator force F is removed from an armature containing a moveable electrical contact.
Figure 4:
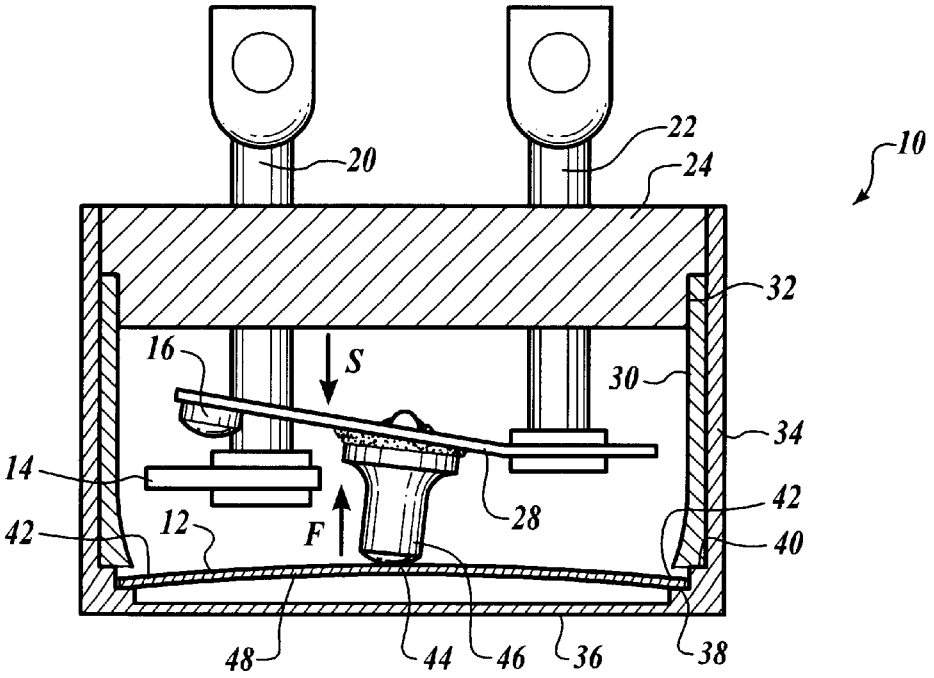
FIG. 4 is another cross-sectional view of the thermally responsive device illustrated in FIG. 2, wherein the thermally responsive snap-action actuator is shown exerting a force on an intermediary striker pin, whereby the actuator force F is transmitted to the armature containing the moveable electrical contact.

FIG. 2 is a top plan view and FIGS. 3 and 4 are cross-sectional views of the thermally responsive device of the present invention embodied as a snap-action thermal switch 10 including a thermally responsive snap-action actuator of the present invention embodied as a snap-action bimetallic disc actuator 12. The thermal switch 10 also includes a pair of electrical contacts 14, 16 that are relatively movable under the control of the disc actuator 12. The electrical contacts 14, 16 are mounted on the ends of a pair of spaced-apart, electrically conductive terminal posts 20, 22 mounted in a header 24 such that they are electrically isolated from one anther. For example, terminal posts 20, 22 are mounted in the metallic header 24 using a glass or epoxy electrical isolator 26.

As illustrated in FIGS. 3 and 4, the electrical contacts 14, 16 are moveable relative to one another between an open state (FIG. 4) and a closed state (FIG. 3). For example, the movable contact 16 is affixed to an electrically conductive carrier 28 that is embodied as an armature formed of an electrically conductive spring material. The armature 28 is affixed in turn in a cantilever fashion to the electrically conductive terminal post 22, such that the spring pressure S of the armature 28 operates to bias the movable contact 16 toward the fixed contact 14 to make electrical contact therewith, as shown in FIG. 3. The electrical contacts 14, 16 thus provide an electrically conductive path between the terminal posts 20, 22 such that the terminal posts 20, 22 are shorted together.

The disc actuator 12 is spaced away from the header 24 by a spacer ring 30 interfitted with a peripheral groove 32. A cylindrical case 34 fits over the spacer ring 30, thereby enclosing the terminal posts 20, 22, the electrical contacts 14, 16, and the disc actuator 12. The case 34 includes a base 36 with a pair of annular steps or lands 38 and 40 around the interior thereof and spaced above the base 36. The lower edge of the spacer ring 30 abuts the upper case land 40. A peripheral edge portion 42 of the disc actuator 12 is captured within an annular groove created between the lower end of the spacer ring 30 and the lower case land 38. The disc actuator 12 operates the armature spring 28 to separate the contacts 14, 16 through the distal end 44 of intermediary of a striker pin 46 fixed to the armature spring 28. Separation of the contacts 14, 16 creates an open circuit condition.

As shown in FIG. 3, while the thermal switch 10 is maintained below a predetermined set-point temperature, the disc actuator 12 is maintained in a first state with the bimetallic disc actuator 12 withdrawn into a space between the lower case land 38 and the case end 36. In this first state, an inner concave surface 48 of the bimetallic disc actuator 12 is spaced away from the intermediary striker pin 46, whereby the actuator force F is removed from the armature 28. The relatively moveable electrical contacts 14, 16 are moved together under the spring pressure S supplied by the armature 28 and thereby form a closed circuit. The spacing between the inner concave surface 48 of the bimetallic disc actuator 12 and the distal end 44 of the striker pin 46 is sufficient to prevent slight movement of the actuator disc 12 effecting contact engagement.

The armature 28 operates under the control of the bimetallic disc actuator 12, which inverts with a snap-action as a function of a predetermined set-point temperature between two stable states of opposite concavity. As shown in FIG. 4, in response to an increase in the sensed ambient temperature above the predetermined set-point, the disc actuator 12 inverts in a forceful snap-action into a loaded relationship with the electrical contacts 14, 16, whereby the inner concave surface 48 is inverted into an outer convex surface 48 that rapidly engages the distal end 44 of the intermediary striker pin 46. The snap-action of the bimetallic disc actuator 12 operates with sufficient force F to overcome the spring pressure S of the armature 28 and flex the movable contact 16 away from the fixed contact 14. The disc actuator 12 pivots the armature spring 28 upwardly to separate the contacts 14, 16 through the intermediary striker pin 46 fixed to the armature spring 28. Separation of the contacts 14, 16 creates an open circuit condition.

The speed at which the bimetallic disc actuator 12 changes state is commonly known as the "creep rate." As the term implies, the change from one stable state to the other is not normally instantaneous, but is measurable. A high creep rate means that the state change occurs at a low rate of speed, while a low creep rate means that the state change occurs at a high rate of speed. High creep rate results in arcing between the contacts 14, 16. High creep rate thus limits the current carrying capacity of the thermal switch 10. In contrast, a low creep rate means that the change in state occurs rapidly, which increases the amount of current the thermal switch 10 can carry without arcing.

According to one embodiment of the invention, the bimetallic disc actuator 12 is fabricated with a low creep rate. Accordingly, the snap-action of the bimetallic disc actuator 12 changes state within about 1 millisecond while exerting sufficient force F to overcome the spring pressure S of the armature 28. The movable contact 16 is thus flexed away from the fixed contact 14 rapidly, so that the current carrying capacity of the thermal switch 10 is maximized.

When the ambient temperature sensed by the bimetallic disc actuator 12 is reduced below the predetermined set-point, the disc actuator 12 is rapidly returned to the spaced-away, noninterference relationship with the electrical contacts 14, 16, as shown in FIG. 3. The relatively moveable electrical contacts 14, 16 are rapidly moved together again under the spring pressure S of the armature 28 and thereby form a closed circuit between the two terminal posts 20, 22. Accordingly, one embodiment of the invention provides a snap-action that changes state of the bimetallic disc actuator 12 within about 1 millisecond. The spring pressure S of the armature 28 causes the movable contact to follow the retreating disc actuator 12. The movable contact 16 is thus flexed into contact with the fixed contact 14 rapidly, so that the current carrying capacity of the thermal switch 10 is maximized.

The thermal switch 10 is sealed to provide protection from physical damage. The thermal switch 10 is optionally hermetically sealed with a dry Nitrogen gas atmosphere having trace Helium gas to provide leak detection, thereby providing the contacts 14, 16 with a clean, safe operating environment.

Figure 1:
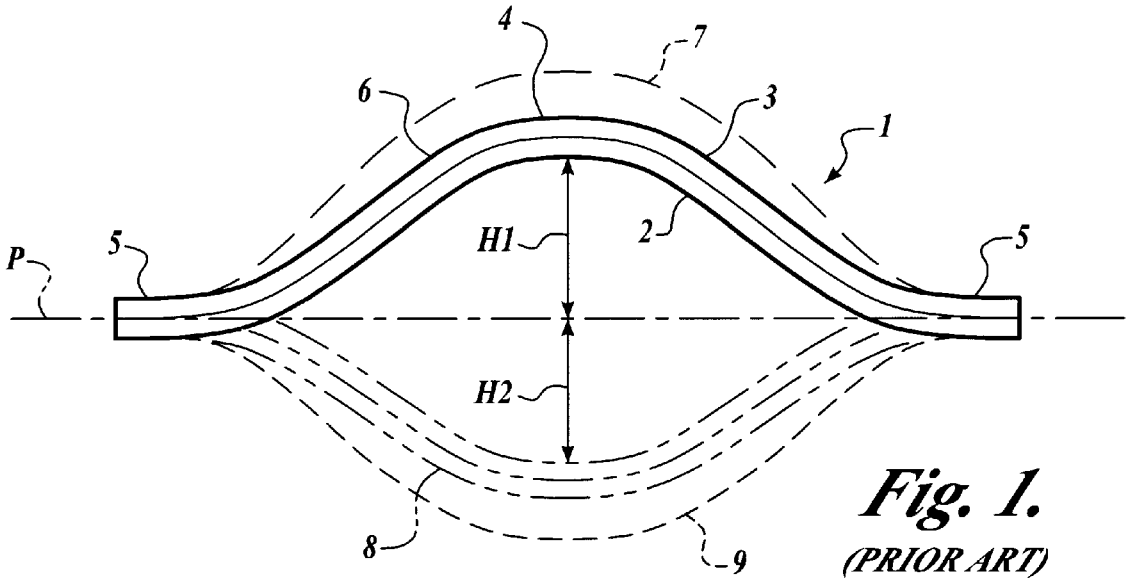
Fig. 1. (PRIOR ART)
FIG. 1 illustrates a known bimetallic actuator disc.
Figure 5:
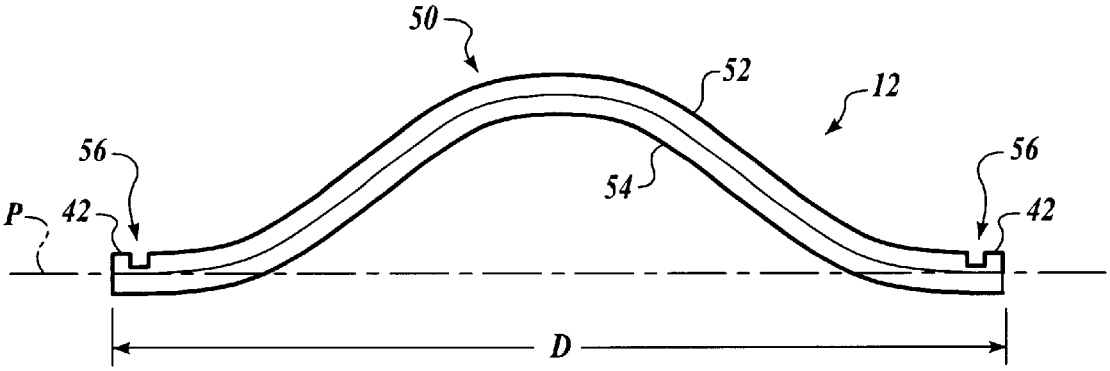
FIG. 5 illustrates the thermally responsive bimetallic member of the invention embodied as the bimetallic disc having a set-point temperature adjusted using a laser surface treatment performed in a prescribed manner according to a method of the invention.

FIG. 5 illustrates the thermally responsive bimetallic member of the invention embodied as the bimetallic disc 12 having a set-point temperature adjusted using the laser surface treatment performed in a prescribed manner according to the method of the invention. The bimetallic disc actuator 12 according to the invention is initially fabricated according to generally known methods, as described in connection with FIG. 1. For example, a thermally responsive bimetallic material 50, such as ASTM-1, is selected according to known criteria for forming a bimetallic actuator. Such thermally responsive bimetallic material includes a first metallic material 52 having a first coefficient of thermal expansion and a second metallic material 54 having a second relatively higher coefficient of thermal expansion. The first and second metallic materials 52, 54 of the thermally responsive bimetallic material 50 are bonded together along one contiguous surface 56.

The bimetallic material 50 is formed into a blank of desired shape and size. For example, a flat, round disk-shaped blank is formed having a diameter D sized to move freely within the annular groove created in the thermal switch assembly 10 between the lower end of the spacer ring 30 and the lower case land 38.

The disk-shaped blank is subjected to a forming or "bumping" operation in which the blank of thermally responsive bimetallic material is positioned between two opposingly positioned shaping members (not shown). The shaping members are actuated to engage the disk-shaped blank of bimetallic material 50, thereby forming bimetallic disc having a configuration that achieves forceful snap-action at each of the two predetermined set-point temperatures. For example, the disk-shaped blank is placed in a female die which supports the blank along its peripheral edge portion 42. A male punch having a spherical end is pressed against the center of the disc to stretch the metal and form the inner dish-shaped concave surface 48. The peripheral edge portion 42 either retains its substantially planar initial shape, or is formed by the shaping members with a substantially planar shape. Examples of such dish-shaped discs are illustrated in U.S. Pat. Nos. 2,717,936 and 2,954,447, each of which is incorporated herein in its entirety by reference. The formed bimetallic disc may be subsequently subjected to a conventional oven heat treatment operation in order to achieve forceful snap-action at each of the two predetermined set-point temperatures.

The dish-shaped bimetallic discs are subjected to thermal testing, which determines the actuation or set-point temperature of each individual disc 12, and the discs 12 are categorized according to a predetermined methodology. For example, the tested discs 12 are separated by material type into categories defined by low set-point temperature ranges of about 1 to 2 degrees Fahrenheit with predetermined differential temperatures. According to the invention, the categorized bimetallic discs 12 are subjected to a laser surface treatment performed in a prescribed manner, whereby the laser treated bimetallic disc 12 of the invention is formed. The laser surface treatment accurately adjusts the set-point temperature of the bimetallic disc 12 upwardly or downwardly in a predictable manner. Variations in the manufacturing parameters of the disc 12 are used to predictably cause different upward and downward changes in the high and low set point temperatures. The manufacturing parameters so varied include, for example, laser intensity, i.e., power and dwell time; location of the localized heat-treated pattern; combinations of different localized surface treatments applied to the high and low expansion sides of the disc 12; forming the bimetallic disc 12 using different types of first and second metallic materials 52, 54; and other parameters.

According to the method of the invention, each bimetallic disc 12 is pre-tested to determine its initial set-point temperature and differential temperature. For example, the bimetallic disc 12 is pre-tested to determine both its initial low set-point temperature and its differential temperature.

One of the first and second materials 52, 54 is inscribed or cut in a predetermined pattern 56 of artifacts, which is a function of the particular bimetallic material 50 and the amount of change required of the particular bimetallic disc 12 to move the set-point to the temperature desired for a particular application. For example, the pattern 56 is inscribed in one of the first and second materials 52, 54 using a laser to generate controlled, isolated heat in a predetermined position. The laser may be any laser operated in a controlled manner to produce the predetermined pattern 56 in the desired position with the desired depth and width to change the set-point to the desired temperature. For example, the laser may be a low-power YAG laser embodied as a conventional laser part marker or scribe.

The parameters that affect the set-point temperature of the bimetallic disc 12 are categorized as the type of bimetal material 50, the physical parameters of the predetermined pattern 56 of one or more artifacts, and the laser power used to inscribe the pattern 56. The type of bimetal material 50 includes the type of the first and second materials 52, 54. The physical parameters of the predetermined artifact pattern 56 include the shape of the pattern 56, i.e., its depth, width, and length; the positioning of the pattern 56 on the bimetallic disc 12; and which of the first and second materials 52, 54 is inscribed with the pattern 56. The laser power used to inscribe the pattern 56 includes the power and speed of the laser during inscription. All of these parameters that influence the degree to which the laser inscription affect the set-point temperature of the bimetallic disc 12. The manner in which the bimetallic disc 12 is subjected to a laser surface treatment is thus a function of these parameters. According to one embodiment of the invention, a nomogram is formulated that quantifies the amount of influence of each of the parameters has on the set-point temperature, including combinations of the parameters. The nomogram is consulted to determine the manner in which the bimetallic disc 12 is subjected to laser surface treatment to change the set-point to the desired temperature. Other representations of the amount of influence of the parameters on the set-point temperature, such as tables, are considered equivalent to the nomogram and are similarly contemplated by the invention.

The nomogram, or other representation of the influence of the parameters on the set-point temperature, is developed using empirical data based upon pre-treatment and post-treatment testing of set-point temperature. For example, a design of experiments (DOE) is developed that efficiently quantifies the amount of influence of the parameters, both individually and in combinations. A statistically significant quantity of the bimetallic discs 12 are fabricated of a predetermined bimetallic material 50, less the laser surface treatment of the invention. The set-point temperatures of the bimetallic discs 12 are pre-tested using conventional methods, and the pre-tested bimetallic discs 12 are categorized accordingly. Optionally, the differential temperatures of the bimetallic discs 12 are pre-tested with the set-point temperatures and the categorizing of the bimetallic discs 12 accounts for variations in differential temperatures.

The pre-tested bimetallic discs 12 are subjected to the laser surface treatment of the invention according to the DOE. The laser surface treated bimetallic discs 12 are post-tested for set-point temperature, and optionally, for differential temperature. The empirical data developed is used to generate the nomogram, or other representation of the influence of the parameters on the set-point temperature.

The nomogram is used to adjust the set-point temperature of bimetallic discs 12 into specific ranges of set-point temperature determined to satisfy a particular application. For example, the set-point temperature of bimetallic discs 12 are adjusted using the laser surface treatment of the invention to adjust the set-point temperature of one or more bimetallic discs 12 by 1 to 10 degrees F. into compliance with a predetermined set-point temperature range required by a particular application.

Figure 6:
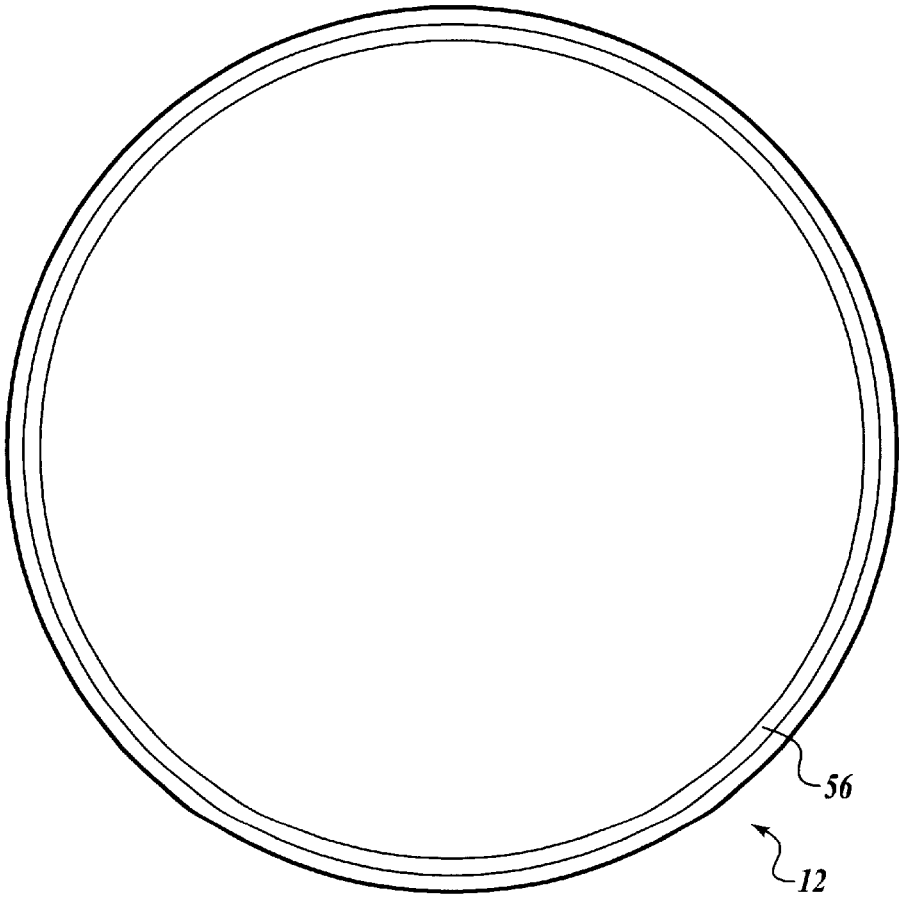
FIG. 6 illustrates in flat pattern the thermally responsive bimetallic member of the invention shown in FIG. 5.

According to one embodiment of the invention, the DOE is performed according to the type of bimetallic material 50, and includes using different laser power settings for applying different shapes of the pattern 56 to both of the first and second materials 52, 54. For example, the artifact pattern 56 is applied to the first material 52 as an annular area of localized surface laser heat-treated material positioned at a short distance from the peripheral edge 48 of the bimetallic disc 12, as illustrated in FIG. 6, where the bimetallic disc 12 is shown in flat pattern. Alternatively, the localized laser treatment is applied with sufficient energy that material is removed and the artifact 56 is embodied as a an annular groove having a predetermined width and depth and positioned at a short distance from the peripheral edge 48 of the bimetallic disc 12, as illustrated in FIG. 5. The grooved artifact 56 is applied in an annular pattern as illustrated in FIG. 6.

Figure 7:
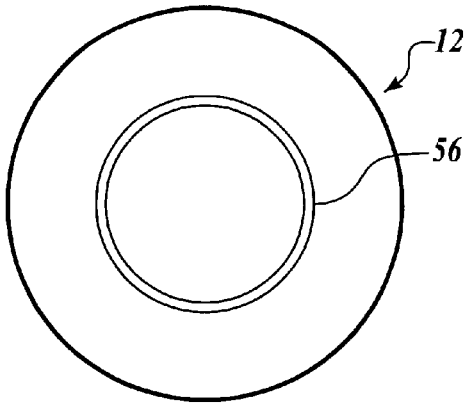
FIG. 7 illustrates the artifact pattern of the invention applied to the bimetallic disc of the invention as a smaller diameter annular artifact pattern positioned part way between the peripheral edge and the center of the bimetallic disc.

FIG. 7 illustrates the artifact pattern 56 is applied to the bimetallic disc 12 as a smaller diameter annular artifact pattern 56 positioned part way between the peripheral edge 48 and the center of the bimetallic disc 12.

Figure 8:
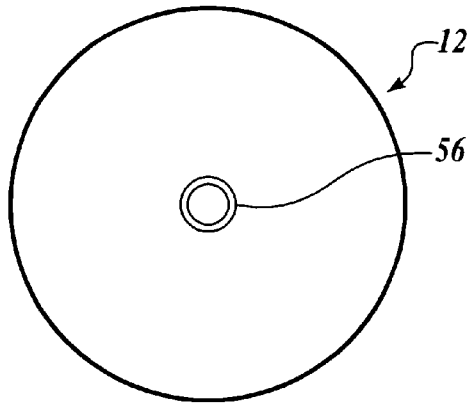
FIG. 8 illustrates the artifact pattern of the invention applied to the bimetallic disc of the invention as a still smaller diameter annular groove positioned at the center of the bimetallic disc.

FIG. 8 illustrates the artifact pattern 56 is applied to the bimetallic disc 12 as a still smaller diameter annular artifact pattern 56 positioned at the center of the bimetallic disc 12. The annular artifact pattern 56 is optionally placed at other positions on the bimetallic disc 12 during the DOE to generate empirical data for the nomogram. Other shapes and locations for the artifact pattern 56 are also optional in generating the empirical data.

According to the invention, the bimetallic disc 12 is subjected to laser surface treatment according to the manner prescribed by the nomogram, or other representation of the influence of the parameters on the set-point temperature. The set-point temperature of the bimetallic disc 12 is thereby adjusted upwardly or downwardly by 1 to about 10 degrees F. to comply with a predetermined set-point temperature range required by a particular application.

Figure 9:
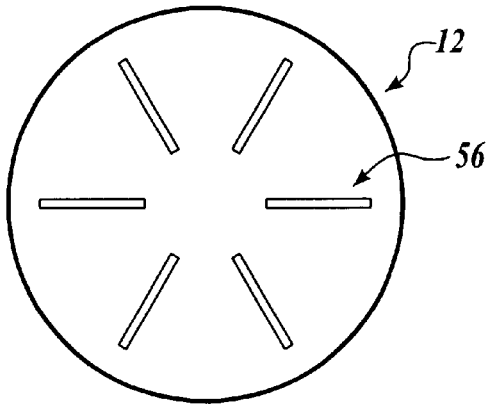
FIG. 9 illustrates the artifact pattern of the invention applied to the bimetallic disc as a quantity of radial heat-treated areas or grooves having a predetermined depth and width.
Figure 10:
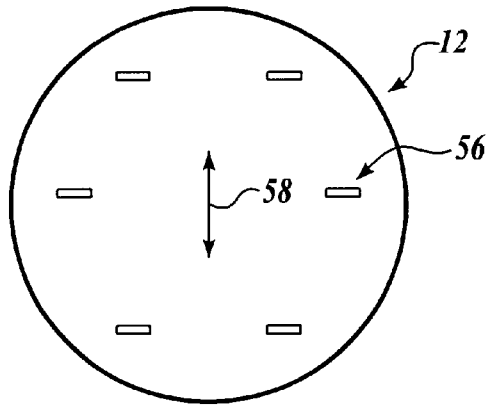
FIG. 10 illustrates the thermally responsive bimetallic member of the invention embodied as a laser adjusted bimetallic disc having a the laser surface treatment applied to inscribe the artifact pattern embodied as a quantity of cross-grain artifacts, wherein the artifact pattern is inscribed at an angle to the rolled grain of one of the first and second materials of the bimetallic member, as indicated by the arrow.

According to other embodiments of the invention illustrated in FIGS. 9 and 10, the laser surface treatment is utilized to adjust the force F with which the bimetallic disc 12 changes state upon sensing its set-point temperature. FIG. 9 illustrates the artifact pattern 56 is applied to the bimetallic disc 12 as a quantity of radial artifacts 56. The laser energy may be applied in a manner that removes material, whereby the artifact pattern 56 is embodied as radial grooves having a predetermined depth and width.

FIG. 10 illustrates the thermally responsive bimetallic member of the invention embodied as a laser adjusted bimetallic disc 12 having a the laser surface treatment applied to inscribe the artifact pattern 56 embodied as a quantity of cross-grain artifacts, wherein the artifact pattern 56 is inscribed at an angle to the rolled grain of one of the first and second materials 52, 54, as indicated by the arrow 58. According to one embodiment of the invention, the artifact pattern 56 is inscribed substantially perpendicular to the rolled grain of the material 52, 54. The artifact pattern 56 is applied as radial (FIG. 9) or cross-grain (FIG. 10) artifacts in one surface of the bimetallic disc 12 to optimize the energy or force F with which the bimetallic disc 12 changes state. The artifact pattern 56 is applied to alter the force F exerted by the stronger change of state by adjusting the tension in the material 52, 54.

The above method of determining the proper combination of parameters to be applied to the artifact pattern 56 is performed using the transition force F as the target characteristic, instead of the set-point temperature.

A representation of the influence of the parameters on the transition force F, such as a nomogram or table, is developed using empirical data based upon pre-treatment and post-treatment testing of transition force F. For example, a design of experiments (DOE) is developed that efficiently quantifies the amount of influence of the parameters, both individually and in combinations. The DOE is used to generate empirical data for the nomogram.

According to the invention, the bimetallic disc 12 is subjected to laser surface treatment according to the manner prescribed by the nomogram, or other representation of the influence of the parameters on the set-point temperature. The transition force F in the snap-action of the stronger side 52, 54 of the bimetallic disc 12 is thereby adjusted downwardly to optimize the transition force F of the snap-action during transition from the first state to the second state and from the second state back to the first state. Generally, the transition force F is optimized to maximize the current carrying capability of the thermal switch 10, as illustrated in FIGS. 2 through 4, when the bimetallic disc 12 is used to open and close the contacts 14, 16 of the thermal switch 10. For example, the transition force F is substantially equalized between the transition from the first state to the second state and the transition from the second state back to the first state.

Obviously, many modifications and variations of the present invention are possible in light of the above teachings. Thus, it is to be understood that, within the scope of the appended claims, the invention may be practiced otherwise than as specifically described above.

What is claimed is:

1. A thermally responsive bimetallic member that exhibits a snap-action response, the bimetallic member comprising:

a bimetallic material fabricated of two materials having different coefficients of thermal expansion and formed in a predetermined non-planar shape to achieve a snap-action between first and second stable states as a function of temperature; and an artifact formed as a localized heat-treated area in a surface of a first of the two materials and cooperating with the non-planar shape to achieve the snap-action.

2. The bimetallic member of claim 1 wherein the artifact cooperates with the non-planar shape to achieve the snap-action within a predetermined range of temperatures.

3. The bimetallic member of claim 1 wherein the artifact includes a groove that cooperates with the non-planar shape to achieve the snap-action within a predetermined range of temperatures.

4. The bimetallic member of claim 1 wherein the snap-action is achieved within a predetermined range of temperatures that is a function at least of a value of the coefficient of thermal expansion of the first of the two materials relative to the coefficient of thermal expansion of a second of the two materials.

5. The bimetallic member of claim 1 wherein the snap-action is achieved within a predetermined range of temperatures that is a function at least of a physical parameter of the artifact.

6. The bimetallic member of claim 5 wherein the physical parameter of the artifact includes one or more of a shape and a position of the artifact.

7. The bimetallic member of claim 1 wherein the snap-action achieved by the cooperating non-planar shape and artifact exerts a predetermined force.

8. The bimetallic member of claim 7 wherein the force exerted by the snap-action is a function of at least a shape and a position of the artifact.

9. The bimetallic member of claim 1 wherein the predetermined non-planar shape of the bimetallic material comprises a dish-shape formed centrally of a substantially planar peripheral edge portion.

10. A thermally responsive bimetallic member that exhibits a snap-action response, the bimetallic member comprising:

a first metallic material having a first coefficient of thermal expansion;

a second metallic material having a second coefficient of thermal expansion different from the first coefficient of thermal expansion, the first and second metallic materials being conjoined along one contiguous surface and having a shape that transitions with a snap-action from a first state of stability to an opposing second state of stability as a function of temperature; and one or more areas of localized heat-treatment formed in one of the first and second metallic materials such that the transition from the first to the second state of stability occurs at a first predetermined set-point temperature.

11. The bimetallic member of claim 10 wherein the first predetermined set-point temperature is different from an initial set-point temperature at which the shape of the conjoined first and second metallic materials transition from the first to the second state of stability.

12. The bimetallic member of claim 11 wherein the first predetermined set-point temperature is different from the initial set-point temperature by an amount that is a function at least of the one or more areas of localized heat-treatment being formed in a predetermined one of the first and second metallic materials.

13. The bimetallic member of claim 12 wherein the one or more areas of localized heat-treatment are formed as one or more grooves.

14. The bimetallic member of claim 13 wherein the one or more grooves are formed having physical parameters including one or more of a depth, a width, a length, and a position on the surface.

15. The bimetallic member of claim 10 wherein the conjoined first and second metallic materials transition from the second state of stability to the first state of stability at a second set-point temperature that is different from the first set-point temperature.

16. The bimetallic member of claim 15 wherein the shape of the conjoined first and second metallic materials determines a differential temperature between the first set-point temperature and the second set-point temperature.

17. The bimetallic member of claim 16 wherein the differential temperature before the one or more areas of localized heat-treatment are formed is substantially the same after the one or more areas of localized heat-treatment are formed.

18. A thermally responsive bimetallic member that exhibits a snap-action response, the bimetallic member comprising:

a bimetallic material fabricated of two thin metal sheets having different coefficients of thermal expansion and being conjoined along one shared surface, the bimetallic material being formed in a predetermined non-planar shape having first and second opposing stable states and being structured to transition between the first and second stable states in response to achieving a predetermined set-point temperature; and a pattern of heat-treated areas formed in a surface of a first of the two metal sheets opposite from the shared surface, the pattern being structured to cooperate with the non-planar shape to generate a snap-action during the transition between the first and second stable states.

19. The bimetallic member of claim 18 wherein the pattern is formed as one or more grooves inscribed into the surface.

20. The bimetallic member of claim 18 wherein the pattern is structured to cooperate with the non-planar shape to generate the snap-action at the predetermined set-point temperature.

21. The bimetallic member of claim 18 wherein the pattern is structured to cooperate with the non-planar shape to optimize an energy generated by the snap-action.

22. The bimetallic member of claim 18 wherein the pattern is formed in the surface of the metal sheet as an annular pattern.

23. The bimetallic member of claim 18 wherein the pattern is formed in the surface of the metal sheet as a radial pattern.

24. The bimetallic member of claim 18 wherein the pattern is formed in the surface of the metal sheet crosswise to a grain of the metal sheet.

* * * * *